US005158179A

United States Patent [19]

Gosselin

[11] Patent Number: 5,158,179

[45] Date of Patent: Oct. 27, 1992

[54] IDENTIFICATION TAG AND GOLF TEE HOLDER

[75] Inventor: Christopher F. Gosselin, Lilburn, Ga.

[73] Assignee: Tee-Tag, Inc., Norcross, Ga.

[21] Appl. No.: 704,213

[22] Filed: May 22, 1991

[51] Int. Cl.[5] ..... B65D 85/20

[52] U.S. Cl. ..... 206/315.1; 206/38; 224/918; 273/32 A

[58] Field of Search ..... 206/3, 38, 37.4, 37.6, 206/37.7, 315.1, 379, 579; 273/32 A, 32 B, 32 D; 224/918

[56] References Cited

U.S. PATENT DOCUMENTS

| | | | |
|---|---|---|---|
| 400,286 | 3/1889 | Bartlett | 206/379 |
| 498,455 | 5/1893 | Bartlett | 206/379 |
| 1,649,245 | 11/1927 | McGraw | 206/315.1 |
| 1,665,214 | 4/1928 | McGraw | 224/918 |
| 2,739,699 | 3/1956 | Blum | 206/379 |
| 3,360,170 | 12/1967 | Scannell et al. | 224/918 |
| 3,753,519 | 8/1973 | Gammon | 224/918 |
| 3,799,331 | 3/1974 | White | 224/918 |
| 3,830,415 | 8/1974 | Jacobson et al. | 224/918 |
| 4,151,937 | 5/1979 | Jarosh et al. | 224/918 |
| 4,407,410 | 10/1983 | Graetz et al. | 206/472 |
| 4,475,676 | 10/1984 | Smith | 224/918 |
| 4,570,894 | 2/1986 | Miele | 224/918 |
| 4,730,728 | 3/1988 | Larkin | 206/315.1 |
| 4,736,877 | 4/1988 | Clark | 224/918 |
| 4,741,434 | 5/1988 | Liebman | 206/38 |
| 4,942,913 | 7/1990 | Musso | 206/37.4 |
| 4,998,726 | 3/1991 | Budnick | 273/32 A |

*Primary Examiner*—David T. Fidei
*Attorney, Agent, or Firm*—James A. Hinkle

[57] ABSTRACT

A combination identification tag and holding apparatus for golf tees which combine advertising indicia and identification indicia within the unitary tag. The tag comprises a box-like shaped member of relatively thin dimensions having paired resilient gripping pegs within the hollow interior of the tag which are designed to accept golf tees for retention therein and allowing easy removal by the user, and further provides a transparent window having a slot to allow the user to slip an identification card under the transparent window.

3 Claims, 2 Drawing Sheets

IDENTIFICATION TAG AND GOLF TEE HOLDER

BACKGROUND OF THE INVENTION

I. Field of the Invention

The present invention relates generally to the field of identification devices and more particularly to a device which not only has the qualities of promoting identification of a person's property, but performs a utilitarian function in combination therewith. Such function is to maintain golf tees in conjunction with the identification device in which the entire combination may be placed upon a golfer's bag or other property.

II. Description of the Prior Art

In the field of identification tags and promotional materials, there are numerous examples of these devices, but generally they are separate and apart from one another. Typically there have been tags in which a person may put a business card, or even attach advertising indicia thereto, and the tag would have some sort of securing means such as a strap which would be held to the property identified. This is especially true in the field of golf.

Further, there have been numerous prior art devices which a golfer maintains near his property, such as his golf club bag, in which there may be located golf tees for easy access and retrieval of desired times.

Typically, the devices of the prior art do not combine the functions of identification, advertising and golf tee holding capability and, even in those devices which have golf tee holders, it has been found that these holders are difficult to use and do not perform the required function in a manner anticipated or required by the golfer.

SUMMARY OF THE INVENTION

In accordance with the present invention, it is contemplated that a combination of an identification tag and a retaining holder for golf tees will be provided which incorporates unique means for gripping golf tees within the holder and wherein the holder permits on one side thereof a business card to be inserted under a transparent window and, on the other side, permits the use of advertising indicia to promote a product or a business.

Yet another object of the invention is the provision of an easily manufactured, relatively inexpensive, identification tag having in combination therewith a retaining holder for golf tees that is of unique design.

Other objects, advantages and capabilities of the invention will become apparent from the following description taken in conjunction with the accompanying drawings, showing only a preferred embodiment of the invention.

DESCRIPTION OF THE PREFERRED EMBODIMENT

Figure 1:
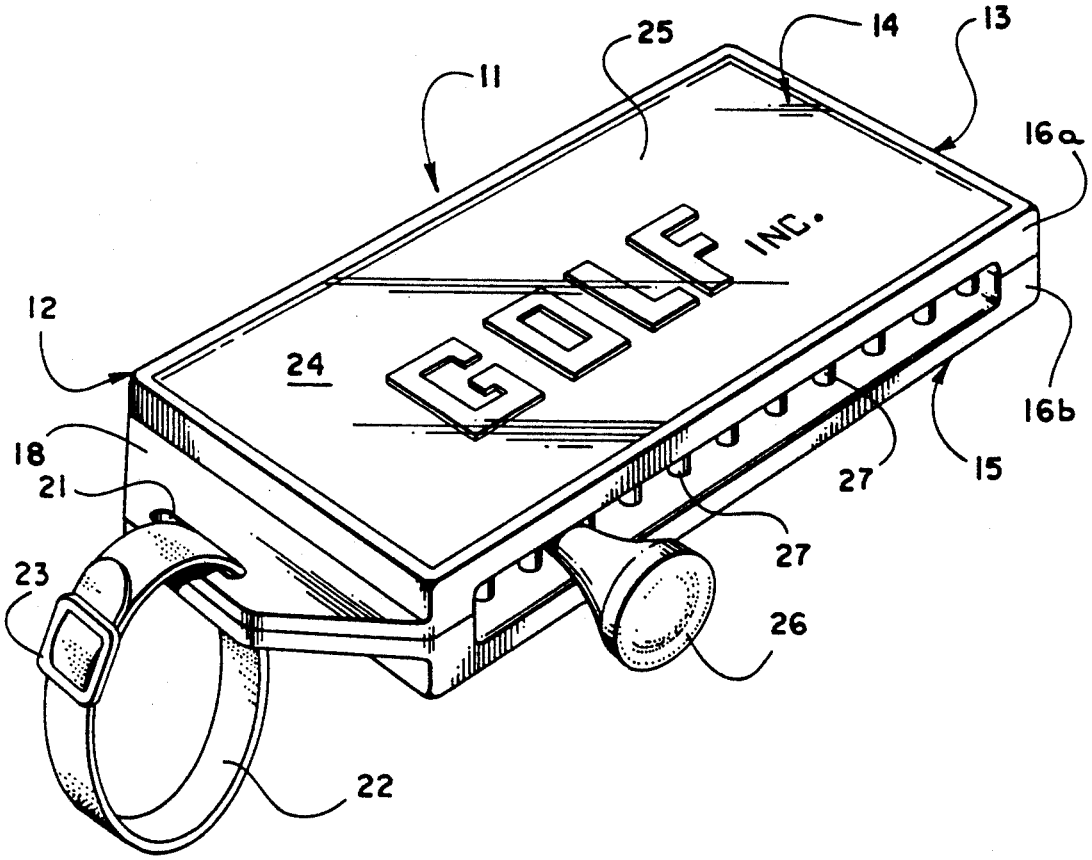
FIG. 1 is a perspective view of the present invention showing its intended mode of use.
Figure 2:
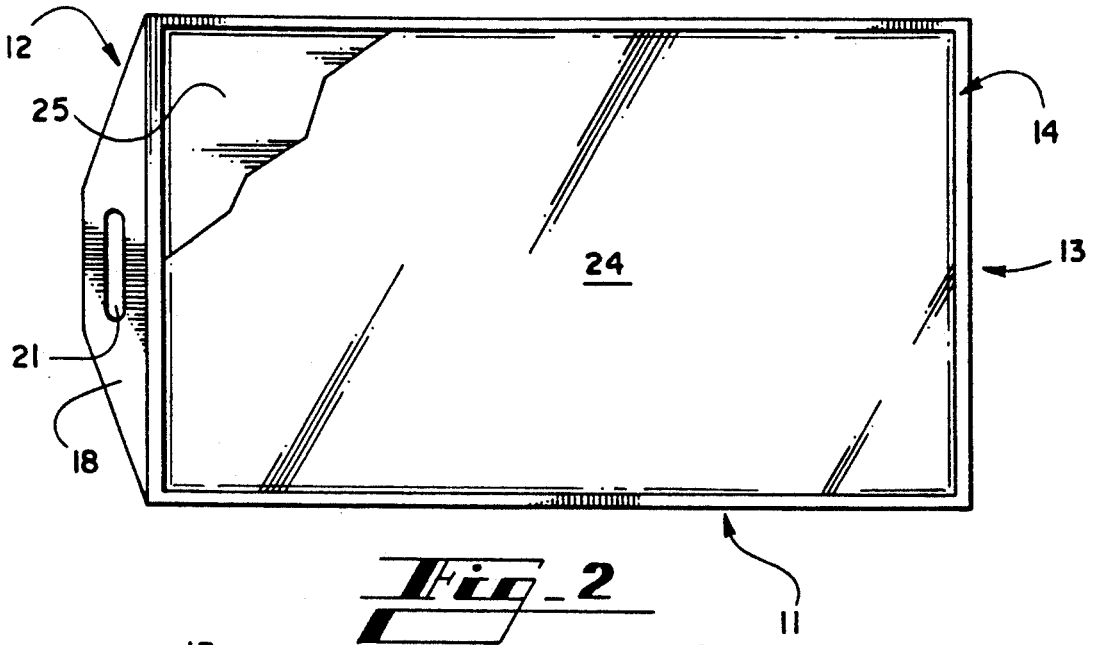
FIG. 2 is a top plan view.

Referring to the drawings wherein like reference numerals designate corresponding parts throughout the several figures, the golf tee tag of the present invention is generally indicated by the numeral 11. The tag generally comprises a box-like structure having a proximal end 12 and a distal end 13.

Figure 3:
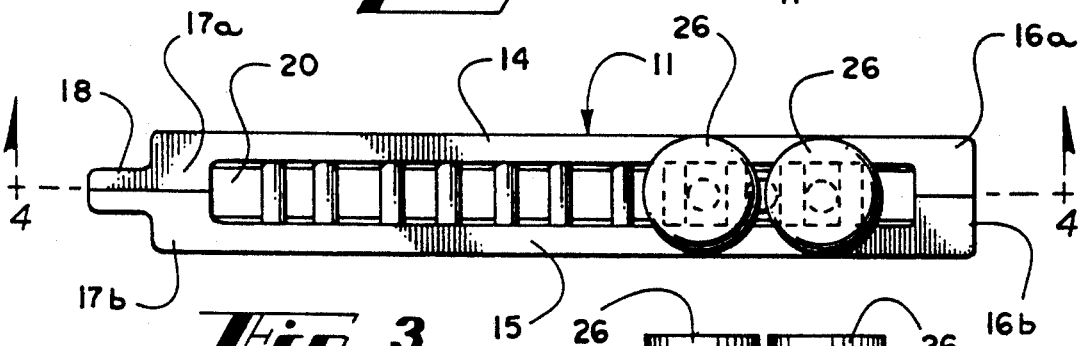
FIG. 3 is a side elevation view.

From the figures it is apparent that the invention comprises mating halves which are placed together to form the final embodiment of the invention and, to this end, the tag 11 may be described as having an upper planar section 14 and a lower planar section 15 which are fitted together in juxtaposition with one another, as more definitively shown in FIGS. 1 and 3, to form the box-like structure of the invention. Each of the planar sections 14 and 15 have respective depending distal end closure members **16*a* and 16*b*, and respective depending proximal end closures 17*a* and 17*b*. Both the distal end closures and the proximal end closures of the respective planar sections are fitted together during manufacture to form the invention and to provide a hollow interior area 20** which communicates with the exterior of the tag.

At the proximal end of the tag 11, and projecting outwardly from each of the planar sections, is upper strap appendage 18 affixed to upper planar section 14, and a lower strap appendage 19 affixed to the lower planar section 15. Within a portion of the strap appendages is a through strap slot 21 into which is placed a hanging strap 22 with a buckle 23 attached thereto for ease of hanging the tag on the owner's equipment.

Inasmuch as it is desired to provide means for identifying the owner's tag 11, the present invention includes a transparent window 24 which is placed atop one of the planar sections. In the drawings shown herewith, the transparent window 24 is placed in conjunction with upper planar section 14. In such a situation the lower planar section 15 would have on its exterior surface advertising indicia of a company or of a product, or could be left blank. As is quite common with devices of this type, the tags are given away as advertising specialty items and the giver typically wishes to have an advertising logo or some other identifying mark to indicate the giver. However, the transparent window would normally cover a typical business card of the owner which would be inserted between the transparent window 24, and the top surface 25 of the upper planar section. It is contemplated that the transparent window will be of a clear plastic which is suitably affixed to the upper planar section 14 around the periphery thereof in such a manner that three sides would be affixed while a fourth side, or edge, would be open to allow the insertion of the owner's business card therein. While it is immaterial which edge might be left open for the business card to be inserted, the most practical approach has been found to be from the proximal end of the tag so that if there is any excessive room between the transparent window 24 and the top surface 25 the card will not be easily dislodged because the hanging strap 22 will typically prevent the card from exiting without assistance of the user.

Figure 4:
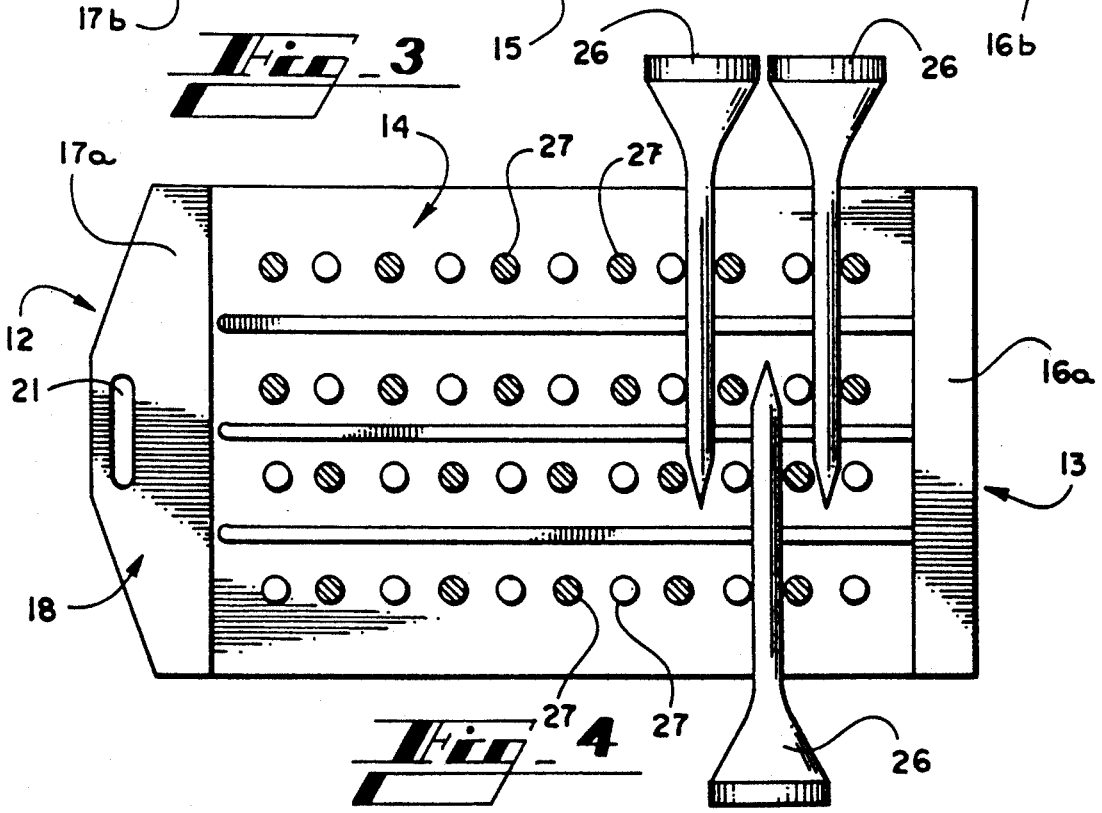
FIG. 4 is a section view taken along Line 4—4 of FIG. 3, showing golf tees inserted in their intended manner.

The present invention also provides a novel approach to maintain the golf tees 26 within the tag. This approach has been to provide gripper means which comprise individual gripper pegs 27 which, when acting in pairs or acting in a paired relationship, will secure a golf tee within the tag when the tee is inserted between pairs of pegs which in turn will grip shaft 28 firmly between the pegs. Such an arrangement is easily seen in FIG. 4 wherein multiple rows of in-line gripper pegs 27 are aligned both between the distal end and the proximal end of the tag 11, and aligned from side to side. Certain of the pegs are shown in FIG. 4 in cross hatch relationship and others are not. The reason for this is that in normal mold making the tag of this invention is molded preferably in two halves with each half containing gripper pegs 27 so that when each half is put together to form the unitary structure, every other peg will be attached at one end to one of the discrete planar sections while the other end of the peg remains free. Generally, the purpose of this is to allow the gripper pegs to have a certain amount of resiliency, as each peg is only attached at one end thereof, so that when the golf tee 26 is inserted through one or more of the paired gripper pegs the shaft is gripped by the pegs and, if the shaft is somewhat smaller than standard or possibly somewhat larger than standard, the various size shafts may be accommodated by the resilient pegs which will close inwardly on a smaller shaft or open somewhat for a fuller shaft.

The foregoing description has fully shown an identification tag having means to selectively insert identification indicia and for the retention of golf tees within the unitary tag in a novel manner not hithertofore known by the prior art. Various modifications may be made of the invention without departing from the scope thereof, and it is desired therefore, that only such limitations shall be placed thereon as are imposed by the prior art and which are set forth in the appended claims.

What is claimed is:

1. An identification tag having means for selectively inserting identification indicia and for retaining golf tees within the tag comprising, an elongated structure having a proximal end and a distal end, the structure further comprising an upper planar section having a proximal end and a distal end, a lower planar section having a proximal end and a distal end, the upper planar section having a depending end closure member at both of the proximal and distal ends, the lower planar section having a depending end closure member at both of the proximal and distal ends, the proximal end closure members and the distal end closure members of each planar section being placed in juxtaposition with one another, the upper and lower planar sections being mounted adjacent to one another and forming a peripheral edge therearound, and further forming a hollow interior area between the upper and lower planar sections which hollow interior is open to the exterior of the structure along a portion of the peripheral edge, multiple gripper means extending into the hollow interior area perpendicularly from at least one of the planar sections, said gripper means being positioned in a paired relationship to form a two-sided gripping surface for retaining the golf tees in the tag when the golf tees are inserted between respective two-sided gripping surfaces, the gripper means comprising a fixed end and a free end, the fixed end being attached to a respective planar section, the gripper means comprising elongated cylindrical pegs, wherein multiple pegs are aligned in straight rows within the hollow interior area between the planar sections, the rows of pegs having a finite distance therebetween and so proportioned to grip the golf tees therebetween.

2. The identification tag as claimed in claim 1, wherein one of the planar sections has a flat exterior surface which is overlaid with a transparent window which defines a finite space between the window and the flat surface, the window having a peripheral edge therearound wherein a portion of the peripheral edge is affixed to the flat surface, slot means within the peripheral edge of the transparent window to define an area in which identifying indicia may be inserted.

3. The identification tag as claimed in claim 2, wherein the proximal end closures of each of the upper and lower planar sections have an outwardly extending juxtaposed appendage, a through slot positioned within each appendage, strap means positioned within the strap slot.

* * * * *